United States Patent [19]

Louiche

[11] Patent Number: 4,869,165

[45] Date of Patent: Sep. 26, 1989

[54] SILKSCREEN PROCESS FOR PRODUCING A DESIGN AND PROXIMATE INSCRIPTION

[75] Inventor: Claude Louiche, Pomponne, France

[73] Assignee: Fabrication d'Ouvrages de Dames, Marevil-les-Meaux, France

[21] Appl. No.: 68,135

[22] Filed: Jun. 29, 1987

[30] Foreign Application Priority Data

Jul. 4, 1986 [FR] France ..... 86 09713

[51] Int. Cl.[4] ..... B41C 1/14; B41M 1/12

[52] U.S. Cl. ..... 101/128.4; 101/115

[58] Field of Search ..... 101/115, 129, 128.4, 101/115; 430/308, 301

[56] References Cited

U.S. PATENT DOCUMENTS

| | | | |
|---|---|---|---|
| T104,305 | 6/1984 | Sattelmaier | 101/115 |
| 592,834 | 11/1897 | Schreurs | 101/115 |
| 677,835 | 7/1901 | Worthington | 101/129 |
| 832,911 | 10/1906 | Jessurun | 430/301 |
| 1,029,543 | 6/1912 | Horvath | 101/115 |
| 1,220,850 | 3/1917 | Jacobs | 101/128.4 |
| 1,237,342 | 8/1917 | Johnsen | 430/301 |
| 1,500,833 | 7/1924 | MacDonald | 101/129 |
| 1,518,426 | 12/1924 | Hatt | 430/301 |
| 1,590,380 | 6/1926 | Keel | 101/129 |
| 1,681,927 | 8/1928 | Bliss | 430/301 |
| 1,814,310 | 7/1931 | Hart | 101/115 |
| 2,114,325 | 4/1938 | Wilkinson | 430/301 |
| 2,122,859 | 7/1938 | Eaton | 430/301 |
| 2,132,635 | 10/1938 | Louft | 101/128.21 |
| 2,139,917 | 12/1938 | Sinn | 430/301 |
| 2,168,444 | 8/1939 | Lake | 430/30 |
| 2,310,965 | 2/1943 | Leavy | 101/129 |
| 2,587,534 | 2/1952 | Schwartz | 101/115 |
| 2,771,026 | 11/1956 | Mooney | 101/129 |
| 3,507,651 | 4/1970 | Wrench | 430/308 |
| 3,987,725 | 10/1976 | Scantlin | 101/129 |
| 4,203,360 | 5/1980 | Madwed | 101/129 |
| 4,262,084 | 4/1981 | Kinney | 430/308 |
| 4,477,557 | 10/1984 | Rauch | 430/308 |

FOREIGN PATENT DOCUMENTS

| | | | |
|---|---|---|---|
| 0329265 | 3/1934 | Fed. Rep. of Germany . | |
| 3334705 | 4/1985 | Fed. Rep. of Germany . | |
| 41224 | 3/1980 | Japan | 101/115 |
| 83167 | 5/1984 | Japan | 101/129 |
| 332767 | 7/1930 | United Kingdom | 101/129 |

*Primary Examiner*—Clifford D. Crowder

*Attorney, Agent, or Firm*—Sandler & Greenblum

[57] ABSTRACT

A process for producing designs on canvas and/or other articles which are adapted to be printed by a silk-screen process. The process involves printing inscriptions around a framed design, with the inscriptions having a color different from the color of the frame on which the inscribed characters are printed. The process involves producing a first composite of a first film sheet which has a border having a predetermined plurality of offset opaque portions and a second film sheet which has a design of a color corresponding to the colors of the plurality of predetermined portions. Another film sheet composite includes a border having a different opaque color and a plurality of transparent portions on the border; the transparent portions being positioned so as to correspond in position to the opaque portions on the border of the first composite. The central portion of the second film sheet composite includes a design for producing a second color, via a silkscreen frame, which is similar to the color of the second border, with the two colors contrasting with each other. In this fashion, the color of the indicia on the border will have different colors.

22 Claims, 2 Drawing Sheets

SILKSCREEN PROCESS FOR PRODUCING A DESIGN AND PROXIMATE INSCRIPTION

BACKGROUND OF THE DISCLOSURE

1. Field of the Invention

The present invention generally relates to a process for producing designs on canvases and similar articles which are printed by a silk-screen process; and specifically relates to a method of printing reference characters around the border surrounding a printed design.

2. Discussion of Prior Art

It is believed that it would be initially helpful to detail how a silk-screen is generally formed. Initially, a film sheet is formed which comprises transparent and opaque portions which correspond to respective portions of the design to be reproduced. Such a film sheet is then applied to a silk-screen screen, which screen is preferably coated with a photosensitive, water-soluble emulsion, which emulsion is capable of hardening when exposed to ultraviolet rays. The entire screen is exposed. Thereafter, the film sheet is removed, and the screen is developed. Beneath the portions which were previously covered by the opaque areas of the film-sheet, the emulsion dissolves, thereby leaving the fabric mesh of the screen open to permit dyes to pass through the screen during the printing process. Dyes are then conducted through the screen or mesh in order to print appropriate designs on a canvas, cloth, or other article.

In actual commercial operation, a canvas in the form of a perforated cloth is used, and is provided along its central portion with a color reproduction of the design which is formed.

Often, around the design or reproduction, it is necessary to make necessary inscriptions, e.g., the trademark of the manufacturer, the canvas order number, and the title of the design to be printed are often placed on the area around the design.

In all of these cases, it is necessary to create as many offset films and silk-screens as there are colors in the samples to be formed; this is a lengthy and expensive operation.

Further, because the fabric of the original canvas generally has either a grey or a beige color, only dark colors can be used to print the inscriptions.

However, if the sample or design to be printed comprises only light colors, it is then necessary to create a supplementary, separate film and silk-screen in order to print the inscriptions using a dark color.

Accordingly, the process of the present invention is adapted to remedy such disadvantages. This process includes the steps of making a frame or border, with indicia thereon, around the design or pattern by using two colors which are selected from the colors in the design as a function of the contrast which they produce. One of the colors is used for the characters, with the other color being used for the border which frames the indicia.

SUMMARY OF THE INVENTION

In a first aspect of the present invention, a process for producing designs on canvases and similar articles is provided. The process includes printing on the article by a silkscreen process. The method comprises printing a design surrounded by a frame or border and inscriptions, with the border and inscriptions including two contrasting colors selected from among colors used in the design. The process further comprises forming a first film sheet having opaque portions in areas in which the inscriptions are to be formed, and combining the first film sheet with a second film sheet having a design corresponding in shape to an area to be printed with a first predetermined color of the design.

A third film sheet has an opaque frame with transparent portions for reproducing the inscriptions of a second color. The third film sheet is combined with a fourth film sheet having a design which corresponds in shape to the shape of a second area on the canvas or article to be printed with a second predetermined color from the design. A first silkscreen is formed by placing the first and second films on the first silkscreen, and a second silkscreen is formed by placing the third and fourth films on the second silkscreen. The silkscreens are then used in a substantially conventional fashion, after the films are removed and the openings revealed.

Another aspect of the present invention provides a method of producing a design on an article which comprises forming a first film composite comprising a plurality of opaque portions in predetermined areas which correspond to areas of the article which are adapted to receive indicia, and forming a second film composite having a central portion of dimensions equal to the dimensions of a central portion of said first film composite. The second film composite has a substantially opaque border with a plurality of transparent characters spaced about the border. The transparent characters are positioned so as to "fit within" the spaced opaque portions of the first film composite. The opaque portion of the second film composite is adapted to form recesses on a second silkscreen in order to print a second predetermined color on said article which is different from a first predetermined color to be printed on the article through a first silkscreen.

The first film composite is formed by attaching a first film having a plurality of opaque portions to a second film having exterior dimensions equal to the dimensions of a central portion of said first film. The second film has a design thereon which is adapted to form recesses on the first silkscreen after exposure of the frame of ultraviolet radiation, in order to silkscreen the first predetermined color.

The second film composite is formed by attaching a third film having a transparent or cutaway central portion and an opaque border to a fourth film having exterior dimensions which are equal to the dimensions of the central portion of said third film, said fourth film having a design thereon which is adapted to form the recesses on the second silkscreen, after exposure of this silkscreen to ultraviolet radiation.

The first and second predetermined colors are selected to contrast; and the method can further comprise forming a plurality of transparent portions on the border frame of a third film, with the transparent portions of the third film frame corresponding in position to the positions of the opaque portions on the border of the first film. The silkscreens are then exposed to ultraviolet radiation and the film composites are removed from the silkscreens. The silkscreens are then successively placed on the article, and a dye of each desired color is conducted through respective single silkscreens.

In a third aspect of the invention, a method of silkscreening is provided which involves printing a first design of an article through a first silkscreen, and printing indicia of a second color on an article around the first design. Simultaneously, an additional design of the second color is printed on the article. A border of the first color is printed on the article simultaneously with printing of the first design. The first and second colors are contrasting. The first color is printed by using a first silkscreen formed by placing a first composite film having spaced opaque portions and a central opaque design portion of a first predetermined shape on a silkscreen. The second color is printed using a second silkscreen formed by placing a second composite film having an opaque border with transparent portions corresponding to the indicia and a central opaque design portion of a second predetermined shape on a silkscreen. Respective colored dyes are then conducted through the resulting silkscreens to produce desired designs.

BRIEF DESCRIPTION OF THE DRAWINGS

The process of the present invention can be better understood by reference to the attached description and accompanying drawings, in which like reference numerals are used to describe similar parts throughout the several views, which drawings are used by way of non-limiting example, and in which.

DETAILED DESCRIPTION OF THE INVENTION

Figure 1:
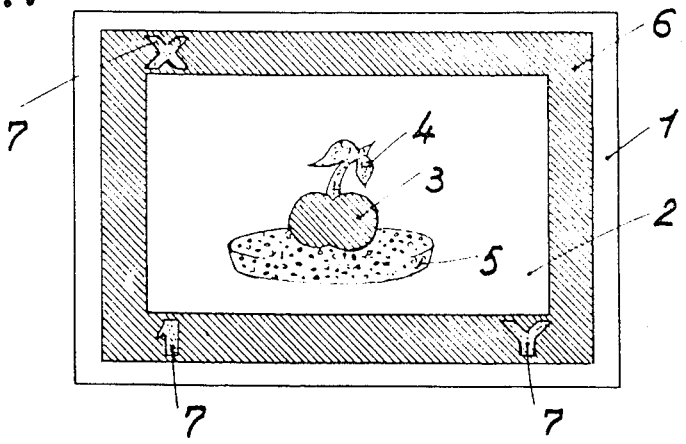
FIG. 1 is a schematic plan view of a printed canvas having a design formed in accordance with the process of the present invention.

In accordance with a first embodiment of the present invention, FIG. 1 illustrates a canvas formed by silkscreening on an ordinary cloth 1. The central portion 2 of the cloth corresponds to the portion to be decorated and includes a design which, e.g., comprises an apple 3 having leaves 4 which rests on a plate 5.

In the illustrated design, e.g., the apple is colored yellow, the leaves pale green and the plate a pale blue.

In accordance with the invention, the central portion 2 of the design is surrounded by a colored strip 6, which is yellow, having an inscription 7 printed in a different color thereon, e.g., in the example illustrated it is printed in pale green (represented by letters X and Y and the numeral 1 in the drawings).

Figure 2:
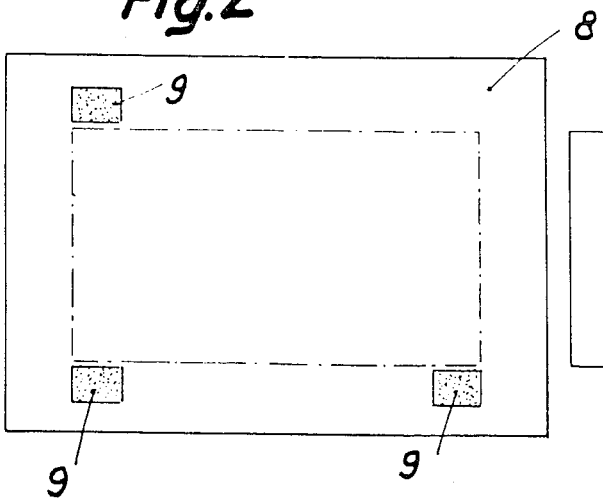
FIGS. 2–7 illustrate successive steps in forming the films in accordance with the process of the present invention, with FIGS. 2–4 illustrating a first composite film and FIGS. 5–7 a second composite used in the process.
Figure 3:
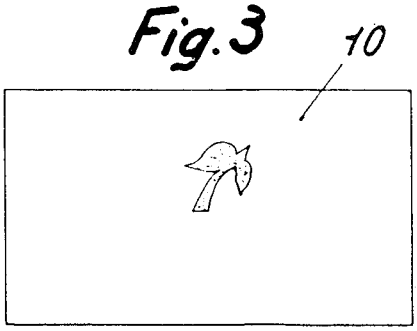
Figure 4:
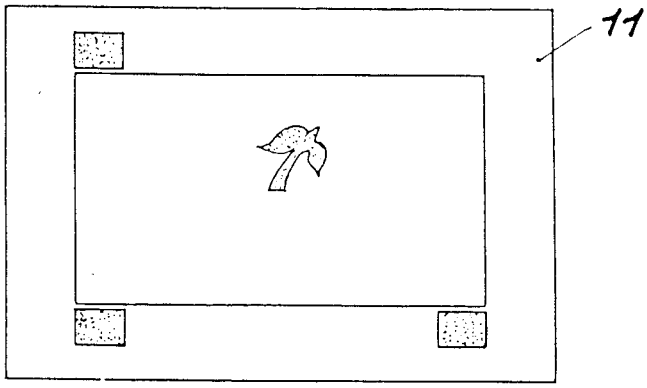

In order to obtain such a result, a first film sheet 8 (seen in FIG. 2) is formed having, in the areas in which writing or inscription will be received, by opaque portions 9. The dimensions of these opaque portions are greater than the dimensions of the inscriptions to be placed on the respective portions of the product which is ultimately being printed upon. The film sheet is combined with a second, film sheet 10, illustrated in FIG. 3, having dimensions which are substantially equal to the dimensions of the central surface portion (outlined by the dashed lines in FIG. 2) of the canvas which is to be decorated (and of film 8). Film sheet 10 has a design which will eventually be colored (on the canvas) so as to correspond to the color used on parts of the first silkscreen initially masked by opaque portions 9; and, accordingly, has, in the example shown, a mask which reproduces the contour of leaves 4. In this fashion, a first film composite or laminate 11 is obtained, thereby making it possible to form a silkscreen which will receive a dye corresponding to the pale green color of the leaves of the apple (see FIG. 4). In other words, a pale green dye will be passed through appropriate areas of a first silkscreen for the apple leaves and the opaque areas 9 used to mark the areas for receiving desired indicia.

Figure 5:
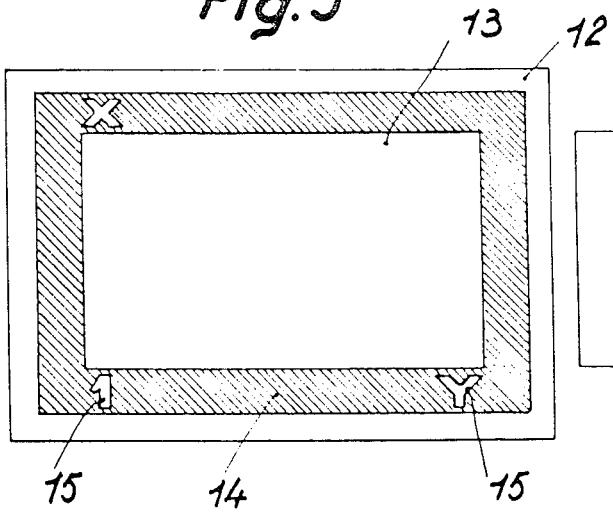
Figure 6:
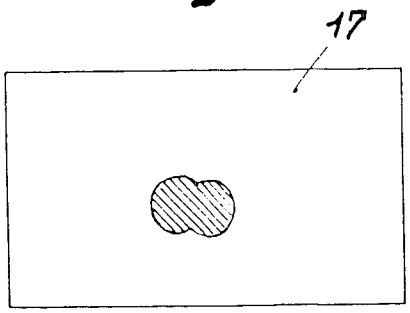

A third film sheet 12 is then formed having a central portion 13 which is either transparent or cutaway and which includes an opaque frame or border 14 which has dimensions which correspond to the dimensions of border 6 of the ultimately printed canvas of FIG. 1; and transparent portions 15, illustrated in FIG. 5, which correspond in position to the desired inscriptions 7. This third film sheet is then combined with fourth film sheet 17, having a design which will form (on a second silkscreen) an area for conducting a dye having a color corresponding to a second color selected, and which, in accordance with the example illustrated in FIG. 6, comprises a mass reproducing the contour of apple 3.

Figure 7:
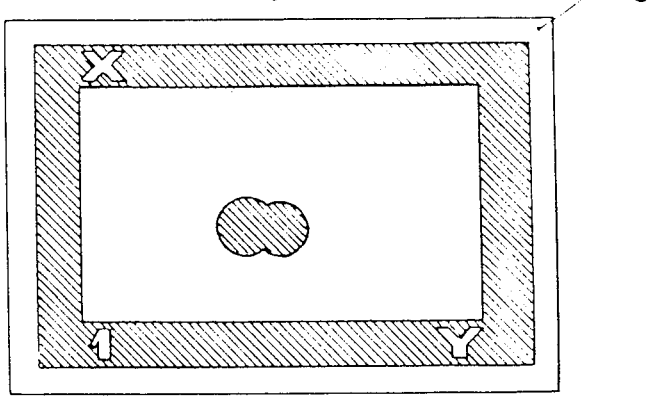

In this fashion, a second definitive composite film sheet 18 is obtained which makes it possible to form a silkscreen having dye conducting areas corresponding to, e.g., the canvas areas for receiving the color yellow, as illustrated in FIG. 7.

It should then be apparent from this description that printing of the inscriptions is effected by using two colors selected as a function of the contrast between them, which colors are selected from the colors which are used to create the design, thereby avoiding the necessity of making a separate silkscreen solely for the inscriptions; consequently, a significant savings in the amount of time and money to silkscreen a desired article with a predetermined design is effected.

It should similarly be noted that first and third film sheets 8 and 12, which are necessary to form the two silkscreens needed to form the inscriptions, are larger than the films corresponding to those used for other colors, and, as a result, can be used for all designs of the same dimensions. For such use, only film sheet 12 need be partially retouched in order to change, e.g., the numbers; as one example, with reference to the drawings, the reference numeral "1" could be replaced by reference numeral "2". Such a change, however, can be quite easily effected.

Formation of films corresponding to other colors which are to be printed can be effected in a similar fashion.

Further, printing of the canvas can be effected by first using a screen adapted to receive the lightest color dye and thereafter using a screen which is adapted to receive the darkest color dye.

It should be apparent to those of ordinary skill in the art that the present invention is not limited to the specific embodiments shown, but instead covers all modifications and embodiments which are within the scope of the claims appended hereto.

What is claimed is:

1. A method of producing a design on a surface which comprises:

(a) forming a first film composite comprising a central portion and a plurality of opaque portions in predetermined areas which correspond to areas of said surface adapted to receive an inscription; and (b) forming a second film composite having a central portion of dimensions equal to the dimensions of said central portion of said first film composite, said second film composite having a substantially opaque border with a plurality of transparent inscription characters spaced about said border, wherein said opaque border of said second film composite comprises means for forming openings on a second silkscreen in order to print a second predetermined color on said surface which is different from a first predetermined color to be printed on said surface through a first silkscreen.

2. A process in accordance with claim 1, wherein said first film composite is formed by attaching a first film sheet having a plurality of opaque portions surrounding said central portion having predetermined dimensions to a second film sheet having exterior dimensions equal to said predetermined dimensions of said central portion of said first film sheet, said second film sheet having a design thereon which comprises means for forming openings on said first silkscreen in order to print said first predetermined color.

3. A process in accordance with claim 2, wherein said second film composite is formed by attaching a third film sheet having a transparent or cutaway central portion having predetermined dimensions and an opaque border to a fourth film sheet having exterior dimensions which are equal to said predetermined dimensions of said central portion of said third film sheet, said fourth film sheet having a design thereon which is adapted to form said openings on said second silkscreen.

4. A process in accordance with claim 3, further comprising forming a plurality of transparent portions on said opaque border of said third film sheet, said transparent portions on said third film sheet corresponding in position to the positions of said plurality of opaque portions surrounding said central portion of said first film sheet.

5. A process in accordance with claim 1, further comprising selecting said first and second predetermined colors to be contrasting.

6. A process in accordance with claim 1, further comprising placing said first film composite adjacent a first silkscreen and said second film composite adjacent a second silkscreen.

7. A process in accordance with claim 6, further comprising exposing said first silkscreen and said second silkscreen to ultraviolet radiation and then removing said first film composite and said second film composite from said first silkscreen and said second silkscreen, respectively.

8. A process in accordance with claim 7, further comprising placing said first silkscreen adjacent said surface and conducting a dye of said first predetermined color through said first silkscreen, removing said first silkscreen from adjacent said surface, placing said second silkscreen adjacent said surface and conducting a dye of said second predetermined color through said second silkscreen.

9. A method of producing a design, and inscription data proximate said design, on an area of a surface, said method comprising:

(a) creating a first silkscreen for printing at least a first portion of said design in a central portion of said area and for partially printing said inscription data outside of said central portion of said area by printing a background area where said inscription data are to be printed;

(b) creating a second silkscreen for printing at least a second portion of said design in said central portion of said area and for at least partially printing the remainder of said inscription data outside of said central portion of said area by printing over at least a portion of said background area in the shape of said remainder of said inscription data; and (c) printing at least a portion of said design and said inscription data with said first silkscreen and said second silkscreen, comprising the steps of:

(i) conducting a dye of a first color through said first silkscreen for printing said at least a first portion of said design and for at least partially printing said inscription data by printing said background area where said inscription is to be printed; and (ii) conducting a dye of a second color through said second silkscreen for printing said at least a second portion of said design and for printing said remainder of said inscription data by printing over said portion of said background area in the shape of said inscription.

10. The method of claim 9, wherein said first silkscreen and said second silkscreen are created in a manner such that said inscription data which is printed conveys information concerning said design.

11. The method of claim 9, wherein said first silkscreen and said second silkscreen are created in a manner such that said inscription data which are printed is a canvas order number or a title of the design.

12. The method of claim 9, wherein said first silkscreen and said second silkscreen are created in a manner such that said inscription data which are printed is the trademark of the manufacturer.

13. The method of claim 9, further comprising, prior to said steps of printing, selecting said first color and said second color from a plurality of colors to be used in printing said design.

14. The method of claim 13, wherein said step of selecting said first color and said second color further comprises selecting said first color and said second color to be contasting.

15. The method of claim 14, wherein said first color is lighter than said second color.

16. The method of claim 9, wherein said steps of conducting a dye of a first color and conducting a dye of a second color through said first silkscreen and said second silkscreen is effective to completely print said inscription data.

17. The method of claim 9, wherein said design and said inscription data are printed on a canvas.

18. The method of claim 9, wherein said design and said inscription data are printed on an article.

19. The method of claim 9, wherein said step of creating said first silkscreen comprises forming a first film composite comprising a central portion corresponding to said central portion of said area of said surface and at least one opaque portion corresponding to an area outside of said central portion.

20. The method of claim 19, wherein said step of forming said first film composite comprises attaching a first film sheet having at least one opaque portion surrounding said central portion having predetermined dimensions to a second film sheet having exterior dimensions equal to said predetermined dimensions of said central portion of said first film sheet, said second film sheet having at least a portion corresponding to said design thereon.

21. The method of claim 20, wherein said step of creating said second silkscreen comprises forming a second film composite having a central portion of dimensions equal to the dimensions of said central portion of said first film composite, said second film composite having a border with a plurality of inscription characters thereon.

22. The method of claim 21, wherein said step of forming said second film composite comprises attaching a third film sheet having a transparent or cutaway central portion having predetermined dimensions and a border to a fourth film sheet having exterior dimensions which are equal to said predetermined dimensions of said central portion of said third film sheet.

* * * * *

UNITED STATES PATENT AND TRADEMARK OFFICE

CERTIFICATE OF CORRECTION

PATENT NO. : 4,869,165

DATED : SEPTEMBER 26, 1989

INVENTOR(S) : Claude LOUICHE

It is certified that error appears in the above-identified patent and that said Letters Patent is hereby corrected as shown below:

Column 1, line 40, delete "offset"; and
Column 6, line 29, change "contasting" to —contrasting—

Signed and Sealed this

Thirteenth Day of August, 1991

*Attest:*

HARRY F. MANBECK, JR.

*Attesting Officer*

*Commissioner of Patents and Trademarks*